United States Patent [19]

Chen

[11] Patent Number: 4,941,589

[45] Date of Patent: Jul. 17, 1990

[54] INNER LINING FOR CARGO CONTAINER

[76] Inventor: Veronica Chen, No. 14, Lane 223, Chin-Shan Rd., San-Min Dist., Kaohsiung City, Taiwan

[21] Appl. No.: 413,893

[22] Filed: Sep. 28, 1989

[51] Int. Cl.[5] ..... B65D 90/04

[52] U.S. Cl. ..... 220/403; 220/470; 206/818

[58] Field of Search ..... 206/818; 220/470, 403

[56] References Cited

U.S. PATENT DOCUMENTS

| | | | |
|---|---|---|---|
| 2,212,326 | 8/1940 | Piken | 206/818 |
| 3,616,622 | 11/1971 | Friedman | 206/818 |
| 4,453,875 | 6/1984 | Johnson, Sr. | 220/403 |
| 4,658,989 | 4/1987 | Bonerb | 220/403 |
| 4,724,955 | 2/1988 | Martin et al. | 220/403 |

*Primary Examiner*—Joseph Man-Fu Moy

*Attorney, Agent, or Firm*—Townsend and Townsend

[57] ABSTRACT

A device for lining the inner surface of a cargo container includes a fluid impervious flexible bag which lines the entire inner surface of the wall of the cargo container, and magnetic elements to hold the flexible bag against the inner surface of the wall of the cargo container, the magnetic elements being distributed on the inner surface of the wall of the cargo container at appropriate intervals.

4 Claims, 5 Drawing Sheets

INNER LINING FOR CARGO CONTAINER

BACKGROUND OF THE INVENTION

This invention relates to a lining for the inner surface of a cargo container, and particularly to a lining arranged to be held against the inner surface of a cargo container.

Generally, cargo containers are used for holding different kinds of cargo. In order to prevent the interior of the containers from being contaminated by the cargo, the containers are usually provided with a replaceable lining bag which will be discarded after use so that cargo placed in a container will not be contaminated by the cargo which is previously held by the container.

FIG. 1 illustrates a known flexible plastic bag for lining the inner surface of a container 10, which is disclosed in U.S. Pat. No. 4,671,733. The plastic lining bag 11 is placed in a container and then inflated with air and adhered to the inner surface of the container by a suction means which draws out the air from the space between the bag and the inner side of the container. Although the bag can be maintained in place when loading the container after the suction force is removed, inconveniences are caused to those conducting the unloading of the container since the bag collapses. Therefore, it is desirable to provide a means that holds the bag against the inner surface of the container.

SUMMARY OF THE INVENTION

An object of the invention is to provide a method of lining a cargo container which employs a means to hold a lining bag against the wall of a cargo container after the suction force applied thereto is removed so that the lining bag will not collapse during the unloading of the cargo container.

According to the present invention, a device for lining the inner surface of a cargo container comprises: a fluid impervious flexible bag which lines the entire inner surface of the wall of the cargo container; and magnetic elements to hold the flexible bag against the inner surface of the wall of the cargo container, the magnetic elements being distributed on the inner surface of the wall of the cargo container at appropriate intervals.

The magnetic elements may be in the form of magnetic strips which are attached to the wall of the cargo container through the layer of the flexible bag which is contacted previously to the wall of the cargo container.

The magnetic elements may be magnetic pieces which are attached to the wall of the cargo container before the flexible bag contacts the wall of the cargo container, wherein bolts and nuts are provided to clamp the flexible bag therebetween, the bolts being adhered to the magnetic pieces.

The bolts may be made of either metal which can adhered to the magnetic pieces through magnetic attraction or plastic which can be adhered to the magnetic pieces by means of an adhesive.

The present exemplary preferred embodiment will be described in detail with reference to the accompanying drawings, in which:

DETAILED DESCRIPTION OF PREFERRED EMBODIMENTS

Figure 1:
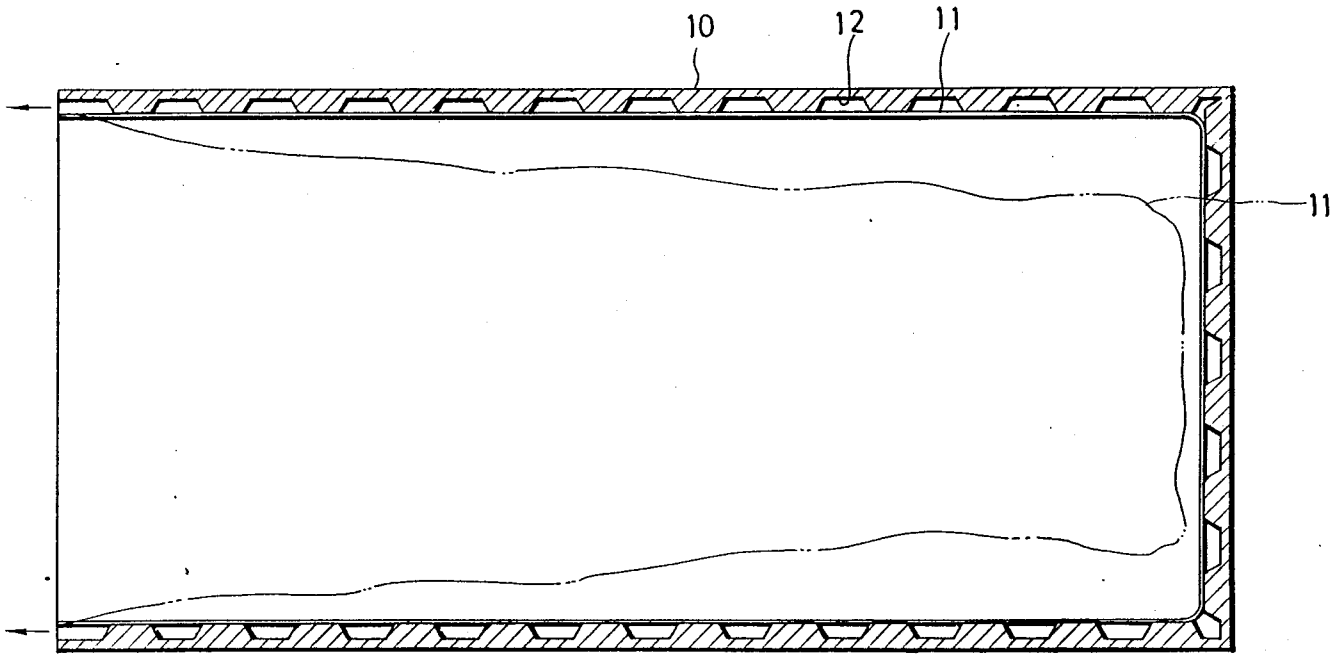
FIG. 1 PRIOR ART
FIG. 1 is a sectional view of a cargo container in which a lining bag is disposed in a conventional way.
Figure 2:
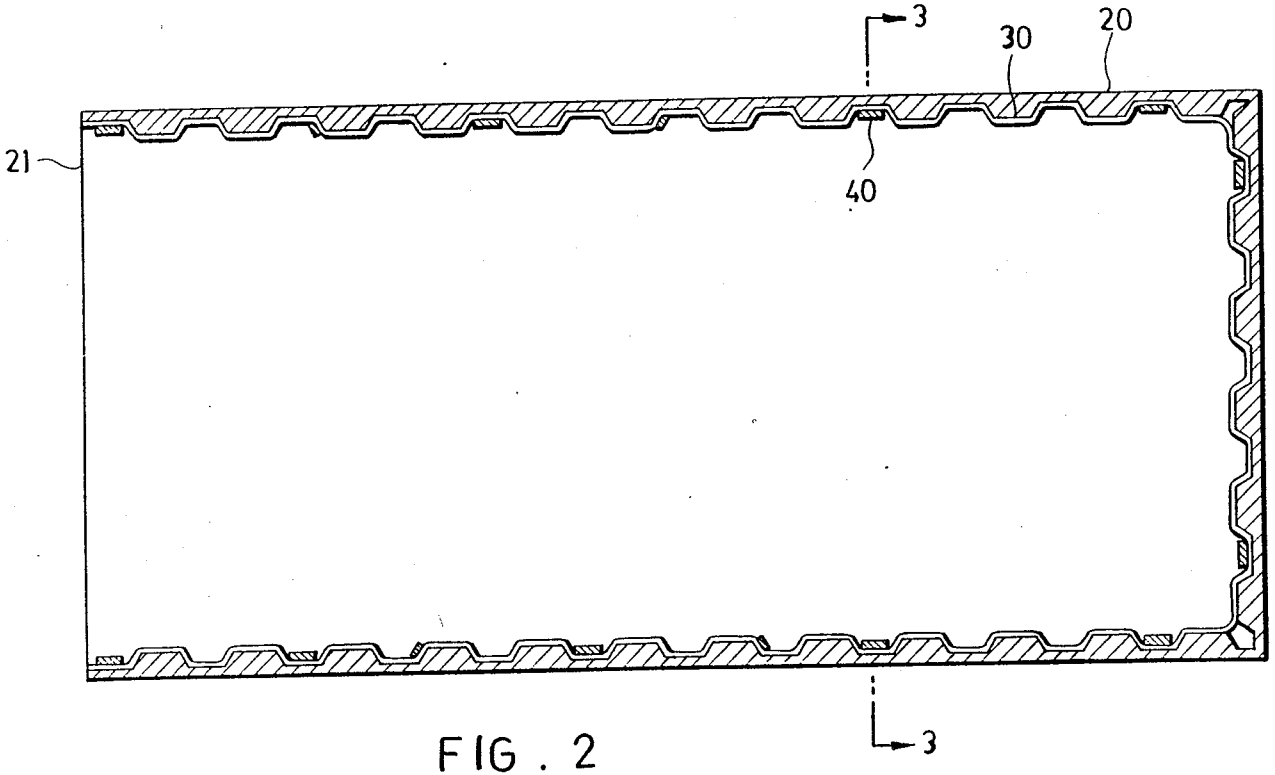
FIG. 2 is a sectional view of a cargo container in which a lining bag is disposed according to the present invention.
Figure 3:
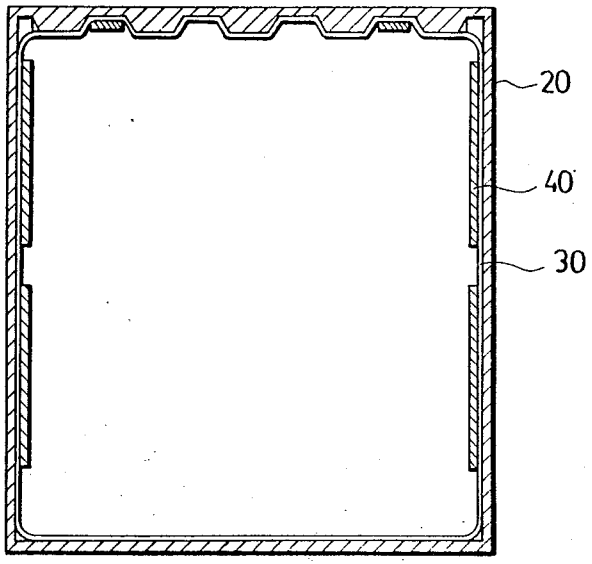
FIG. 3 is a sectional view taken along line 3—3 of the present invention.

Referring to FIGS. 2 and 3, a cargo container 20 is shown, having a flexible lining bag 30 adhered to the inner surface of the wall of the container 30. Magnetic strips 40 are used to hold the bag 30 firmly against the wall of the container 30.

In the process of lining the container 20 with the bag 30, the bag 30 is first put into the container 20 with the open end of the bag 30 being disposed adjacent the open end 21 of the container 20. Then, the open end of the bag 30 is secured to the open end of the container 20 by means of magnetic strips 40. A space (not shown) is left between the open end of the bag 30 and the open end of the container 20 to permit a suction device (not shown) to draw the air out from the space between the bag 30 and the wall of the container 20. When the bag 30 is inflated with air and the air between the bag 30 and the wall of the container 20 is drawn out therefrom, the bag 30 contacts the wall of the container 20. Magnetic strips 40 are adhered to the wall of the container 20 at intervals by magnetic attraction, thereby clamping the bag 30 firmly against the wall of the container 20.

Figure 4:
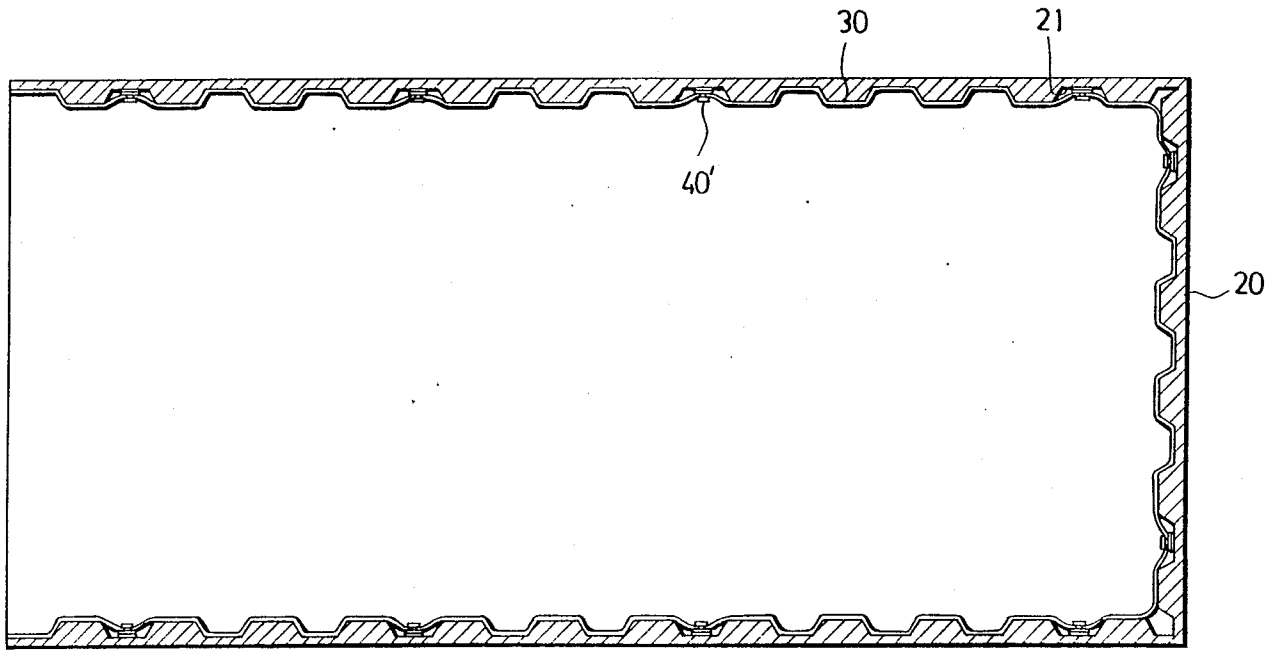
FIG. 4 is a sectional view of a cargo container incorporating a lining bag held against the wall of the container with magnetic pieces and screw members.
Figure 5:
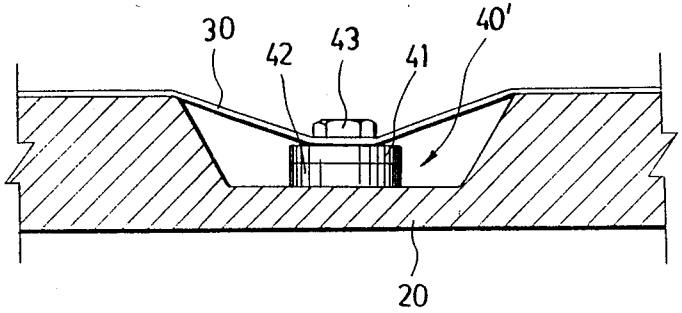
FIG. 5 is an enlarged fragmentary sectional view showing a magnetic piece and a screw member of FIG. 4.

FIGS. 4 and 5 show holding elements 40' to be used in place of the magnetic strips 40. Each holding element 40' includes a magnetic piece 42 adhering to the wall of the cargo container by magnetic attraction, a screw bolt 41 adhered to the magnetic piece 42, and a nut 43 clamping the bag against the head of the bolt 41. The bolt 41 and the nut 43 may be either metal or plastic . In the case of plastic, the bolt 41 should be adhered to the magnetic pieces by using an adhesive. The magnetic pieces 42 are attached to the wall of the cargo container at appropriate distances sufficient to prevent the lining bag from collapsing.

Figure 6:
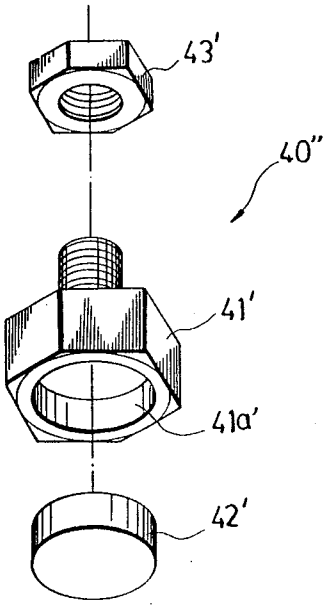
FIG. 6 is an exploded view showing another form of the magnetic piece and the screw member.

FIG. 6 shows an alternative form of the holding element 40'' in which the head of the bolt 41' is provided with a recess **41*a'* so that a magnetic piece 42' can be fitted snugly in the recess 41*a'***.

With the invention thus explained, it is apparent that variations and modifications can be made without departing from the scope of the invention. It is therefore intended that the invention be limited as indicated in the appended claims.

What I claim is:

1. A device for lining the inner surface of a cargo container comprising:

a fluid impervious flexible bag which lines the entire inner surface of the wall of the cargo container; and magnetic pieces to hold the flexible bag against the inner surface of the wall of the cargo container, the magnetic elements being distributed on and attached to the inner surface of the wall of the cargo container at appropriate intervals before the flexible bag contacts the wall of the cargo container;

bolts adhered to said magnetic pieces; and nuts to clamp the flexible bag between said bolts and nuts.

2. A device as claimed in claim 1, wherein said magnetic elements are in the form of magnetic strips which are attached to the wall of the cargo container by magnetic attraction through the layer of the flexible bag contacting the wall of the cargo container.

3. A device as claimed in claim 1, wherein said bolts are made of metal and adhered to the magnetic pieces through magnetic attraction.

4. A device as claimed in claim 1, wherein said bolts are made of plastic and adhered to the magnetic pieces by means of an adhesive.

* * * * *